US007153084B2

(12) United States Patent
Horst et al.

(10) Patent No.: US 7,153,084 B2
(45) Date of Patent: Dec. 26, 2006

(54) BOOM CLAMP

(75) Inventors: Jay K. Horst, Lititz, PA (US); Carmelo C. Abreu, Reinholds, PA (US)

(73) Assignee: CNH America LLC, New Holland, PA (US)

( * ) Notice: Subject to any disclaimer, the term of this patent is extended or adjusted under 35 U.S.C. 154(b) by 4 days.

(21) Appl. No.: 11/099,299

(22) Filed: Apr. 5, 2005

(65) Prior Publication Data

US 2006/0245895 A1 Nov. 2, 2006

(51) Int. Cl.
*E02F 9/14* (2006.01)

(52) U.S. Cl. ..... 414/680; 292/256; 292/288; 414/686

(58) Field of Classification Search ..... 414/680, 414/694, 686; 70/19; 292/256, 288, 289, 292/292

See application file for complete search history.

(56) References Cited

U.S. PATENT DOCUMENTS 4,141,257 A * 2/1979 Hammond et al. ..... 74/529
4,260,321 A * 4/1981 Beauchamp et al. ..... 414/694

* cited by examiner

*Primary Examiner*—Donald Undrwood
(74) *Attorney, Agent, or Firm*—Stephen A. Bucchianeri; John William Stader; Michael G. Haruis

(57) ABSTRACT

A boom clamp for a work vehicle having a lock and a boom is provided, the lock being configured to prevent movement of the boom in a first direction, the clamp comprising a restraint configured to engage the boom; and a sleeve fixed to the restraint, the sleeve configured to engage the lock; wherein the restraint prevents the boom from moving in a second direction.

13 Claims, 3 Drawing Sheets

BOOM CLAMP

FIELD OF THE INVENTION

The invention relates generally to agricultural and construction vehicles, and more particularly to skid steer loaders. The invention, in combination with existing locking pins, prevents loader arms from moving in two directions.

BACKGROUND OF THE INVENTION

Skid steer loaders and other work vehicles with traversing booms typically require maintenance both in the field and in a dedicated repair shop. The repairman needs access to all parts of the vehicle. Lifting the booms to an intermediate position is required, allowing manual access to the otherwise blocked area of, for example, a skid steer loader. Skid steer loader arms, or booms, are hydraulically controlled. If there are small leaks in the hydraulic system, the booms will slowly lower over time. To avoid this, there are various common mechanisms for preventing booms from lowering inadvertently. These include locking the boom control levers in the operator cab, placing a block such as a drum under the implement at the end of the booms, and locking the boom(s) itself.

In the area of boom locking devices the prior art teaches various methods of locking a boom for transport. Typically the boom is lowered against the chassis such that the chassis blocks movement in one direction and the boom lock blocks movement in the opposite direction. One example of a transport boom lock uses an operator in-cab control with a linkage to a pin or hook assembly that locks a backhoe boom against the chassis in the boom's fully upright position. While this locks the backhoe boom against all movement, it requires the boom to be in a non-working position, i.e. fully upright, as for transport. This blocks access to part of the backhoe for repair.

The prior art also teaches locks that are carried on the boom itself, either on the housing, rod or cylinder, locking the boom in an intermediate position. One example teaches a lock that is placed on the end of the hydraulic cylinder, and acts against the rod and cylinder, preventing retraction of the rod into the cylinder and thereby preventing the loader arm from lowering. This method only prevents the boom movement in one direction relative to the boom itself, that of the rod retracting into the cylinder, i.e. boom contraction.

The prior art also teaches locking pins that extend through the cab wall and extend into the plane of the skid steer loader arms, locking the booms in an intermediate position. This method prevents the loader arms from lowering with respect to the cab, but not from raising.

However, in the case of a skid steer loader with a removable combined cab and boom assembly, the situation is different. The cab and boom are tilted away from the base of the vehicle during the repair. As a result, the boom overhangs the end of the vehicle considerably. While the skid steer loader may be equipped with locking pins or sliding bars that prevent the loading arms from lowering (see U.S. Pat. No. 3,730,362 for a complete description of the layout and function of such locking pins), the weight of the cab and boom assembly will tend to pull the boom arm upwards from the cab and away from the locking pins. During repair, the implement at the end of the boom arms (bucket, rake, blade, dozer blade, etc) will typically be supported on a stand. By the force of gravity, the tilted cab boom assembly will descend toward the ground if there is a hydraulic leak, causing the boom arms to pivot upward with respect to the cab. In other words, the existing locking device only prevents the boom from pivoting downward with respect to the cab, and what is needed is a second complimentary device, or boom clamp, to prevent boom movement in the other direction. What is further needed is a simple, low cost-to-manufacture boom clamp. What is also needed is a clamp that a repairman or operator can install and remove quickly without tools when needed. What is further needed is a boom clamp that will not pinch hydraulic cables.

SUMMARY OF THE INVENTION

In accordance with a first aspect of the invention, a boom clamp for a work vehicle having a lock and a boom, said lock configured to prevent movement of the boom in a first direction is provided, the boom clamp comprising a restraint configured to engage the boom, and a sleeve fixed to the restraint, the sleeve configured to engage the lock, wherein the restraint prevents the boom from moving in a second direction.

The second direction may be opposite the first direction. The lock may be movable between a first position and a second position, wherein the lock does not prevent the boom from moving in the first direction when the lock is in the first position, wherein the lock prevents the boom from moving in the first direction when the lock is in the second position, and further wherein the restraint prevents the boom from moving in the second direction when the lock is in the second position. The clamp may be configured to be installed and removed by an operator without tools. The boom clamp may further comprise a handle configured to be grasped by an operator during installation and removal of the clamp. The sleeve may be configured to surround the lock. The lock may be a pin and the sleeve may be a cylinder. The restraint may comprise a first plate fixed to the sleeve and configured to face a lower surface of the boom, a second plate fixed to the first plate and configured to extend parallel to the boom, and a third plate fixed to the second plate configured to face an upper surface of the boom. The boom may further include hydraulic lines, and a shroud surrounding the hydraulic lines, wherein the restraint is configured to surround the shroud.

In accordance with a second aspect of the invention, a boom lock for a skid steer loader, said skid steer loader having a chassis, an operator cab removably attached to the chassis, and a boom pivotally coupled to the operator cab is provided, the boom lock comprising first means for preventing the boom from pivoting in a first direction with respect to the cab, and second means for holding the first means and the boom together.

The second means may prevent the boom from pivoting in a second direction with respect to the cab. The first means may comprise a locking pin movably attached to the cab. The second means may comprise a boom restraint and a pin sleeve. The second means may be removably attached to the first means and the boom.

In accordance with a third aspect of the invention, a method for locking a boom on a work vehicle is provided, comprising the steps of extending a locking pin to prevent motion of the boom in a first direction, and coupling a clamp to the locking pin after the step of extending, to prevent motion of the boom in a second direction.

The step of extending may include extending the locking pin from an operator cab. The step of extending may include moving the boom to a position adjacent the locking pin. The step of coupling may include sliding the locking pin into a hole in the clamp after the step of extending. The clamp may be c-shaped and the step of coupling may include sliding the clamp around the boom. The step of coupling may include sliding the clamp around a protective shroud.

DETAILED DESCRIPTION OF THE PREFERRED EMBODIMENTS

Figure 1:
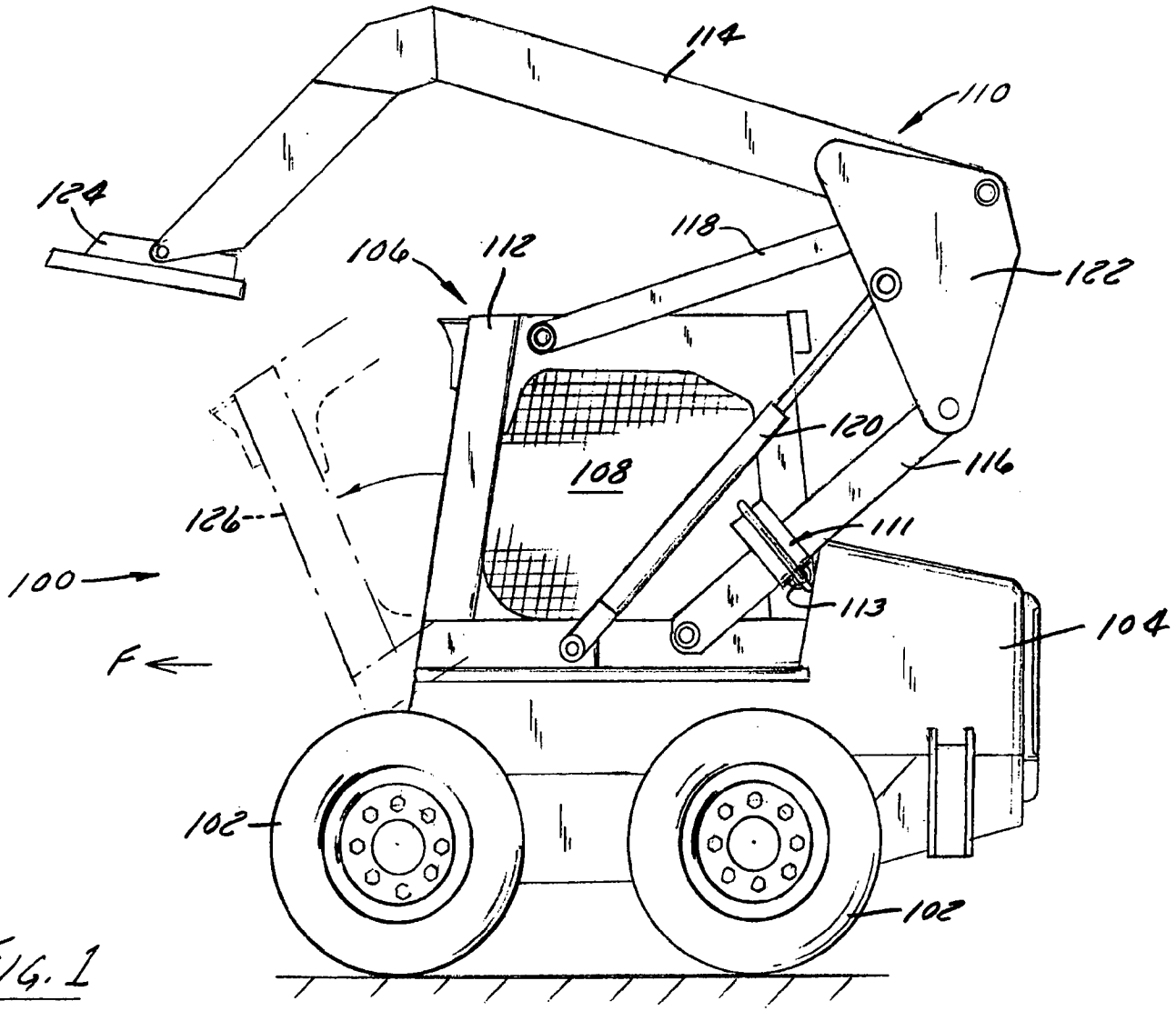
FIG. 1 is a side view of a skid steer loader with the invention attached.

FIG. 1 shows a skid steer loader 100 for material handling viewed from the left side, with the booms locked in an intermediate position according to the present invention. The "front" of the vehicle is defined as the direction of normal forward movement and the direction the operator will face when operator will face when operating the vehicle to handle materials, and is shown in FIG. 1 by the directional arrow F. The directions of boom movement of "up" and "down" are relative to the operator cab.

The loader includes wheels 102, a main body frame 104, and a cab boom assembly 106. The wheels 102 (left front and rear wheels shown, right front and rear wheels not visible in this drawing) are rotatably coupled to and support the main body frame 104. The main body frame 104 encloses the engine, drive mechanism, and hydraulics (not shown), and supports the cab boom assembly 106.

The cab boom assembly 106 is removably attached to the main body frame and rests on top of the frame. The assembly 106 includes the operator cab 108, the boom structure 110, and the boom clamp 111. The operator sits in the operator cab while operating the skid steer loader. Operator controls and seat (not shown) are enclosed by the cab. The cab is composed of left and right sidewalls 112, a roof, and a (left, right) pair of boom locking pins 113. The right sidewall and roof are not visible in FIG. 1. The boom structure 110 is pivotally attached to the left and right side of the cab 108.

The boom structure 110 uses hydraulics and a four-bar linkage to move materials with an implement according to operator commands issued via control levers in the cab 108. The FIGS. 1–4 show only the left side portion of the boom structure 110. An identical mirror-image right side boom structure (not shown) is coupled to the right side of the cab. The left side portion and the right side portion together comprise the boom structure 110. In all ways other than as stated below, the function and interconnection of the right boom elements is identical to that of the left boom elements. The boom structure comprises left side and right side upper boom arms 114, left and right side lower boom arms 116, left and right side supporting links 118, left and right side hydraulic cylinders 120, left and right side linkage plates 122 and an implement mounting plate 124. Further description relates to the left side interconnections of the boom structure, however the right side of the boom structure is interconnected identically.

The upper boom arm 114, the supporting link 118, the hydraulic cylinder 120 and the lower boom arm 116 are all coupled to the linkage plate 122 and, together with the cab, create a four-bar linkage. One end of the lower boom arm 116 is pivotally attached to a rearward section of the sidewall 112 of the cab 108 and extends generally rearwardly and upwardly. The other end of the lower boom arm is pivotally attached to a lower portion of the linkage plate 122. The cylinder end of the hydraulic cylinder 120 is pivotally attached to a central section of the sidewall 112 and extends generally rearwardly and upwardly. The rod end of the hydraulic cylinder is pivotally attached to a central section of the linkage plate 122. One end of the supporting link 118 is pivotally attached to an upper section of the sidewall 112 and extends generally rearwardly. The other end of the supporting link is pivotally attached to an upper section of the linkage plate 122. One end of the upper boom arm 114 is pivotally attached to the implement holder 124 and extends generally rearwardly and upwardly, curving down. The other end of the upper boom arm is fixed to an upper section of the linkage plate 122.

The boom structure 110 operates in a left vertical plane parallel to the left sidewall 112 and a right vertical plane parallel to the right sidewall 112 (not shown). By extending the hydraulic cylinder 120, the four-bar linkage moves such that the implement holder 124 located at the front end of the upper boom arms 114 moves upward. Conversely, retracting the hydraulic cylinder moves the implement holder downward. Further details of the boom structure can be found in U.S. Pat. No. 3,215,292.

Locking pins 113 (only the left side shown, an identical pin exists on the right side) are slidably supported by the cab of the vehicle. They are configured so the operator can slide them laterally and horizontally from a first position in which they do not interfere with the movement of the boom to a second outward position where they interfere with the movement of the boom, preventing it from pivoting downward. (See FIGS. 2 & 3 and additional details in U.S. Pat. No. 3,730,362 which is incorporated herein by reference for all that it teaches.)

In FIG. 1, the operator has extended the hydraulic cylinder 120 far enough such that the lower boom arm 116 is above locking pin 113. The operator has then engaged the locking pin 113 by moving it from the first non-interfering position laterally outward from loader 100 to the second interfering position. The locking pin 113 extends through the sidewall 112 of the operator cab 108 and crosses the left vertical operation plane of the boom structure 110. The operator has then retracted the hydraulic cylinder and lowered the lower boom arm 116 until it is close to or resting on the locking pin 113. The operator has then installed the boom clamp 111, by getting out of the vehicle, picking up the boom clamp, orienting it with the locking pin 113, orienting it with the lower boom arm 116, and simultaneously sliding it over the lower boom arm 116 and the locking pin 113. The combination of the locking pin and the boom clamp prevent the lower boom arm, and thus the entire boom structure 110, from pivoting either upward or downward with respect to the cab 108. The hydraulic cylinder 120 is under compression from the weight of the boom structure 110.

FIG. 1 also shows, in phantom, a tilted position 126 of the cab boom assembly 106. This is a common position during repairs, allowing the repairman access to the components contained within the main body frame 104. It can be seen that tilting the cab boom assembly 106 toward the front moves more of the boom structure 110 and cab 108 closer to or forward of a vertical centerline of the vehicle. This causes the weight of the cab, implement holders 124 and upper boom arms 114 to act upon the hydraulic cylinder 120 such that the cylinder is under extension rather than compression. When the cab 108 is tilted thusly, if there is a hydraulic leak the weight of the cab will tend to cause the cylinder to extend and the lower boom arm 116 to pivot upward with respect to the cab unless the lower boom arm is locked from upward movement (with respect to the cab) with the boom clamp 111. Thus the boom clamp provides additional useful boom locking functionality as compared to the locking pin 113 which only prevents the lower boom arm 116 from moving downward (with respect to the cab).

Figure 2:
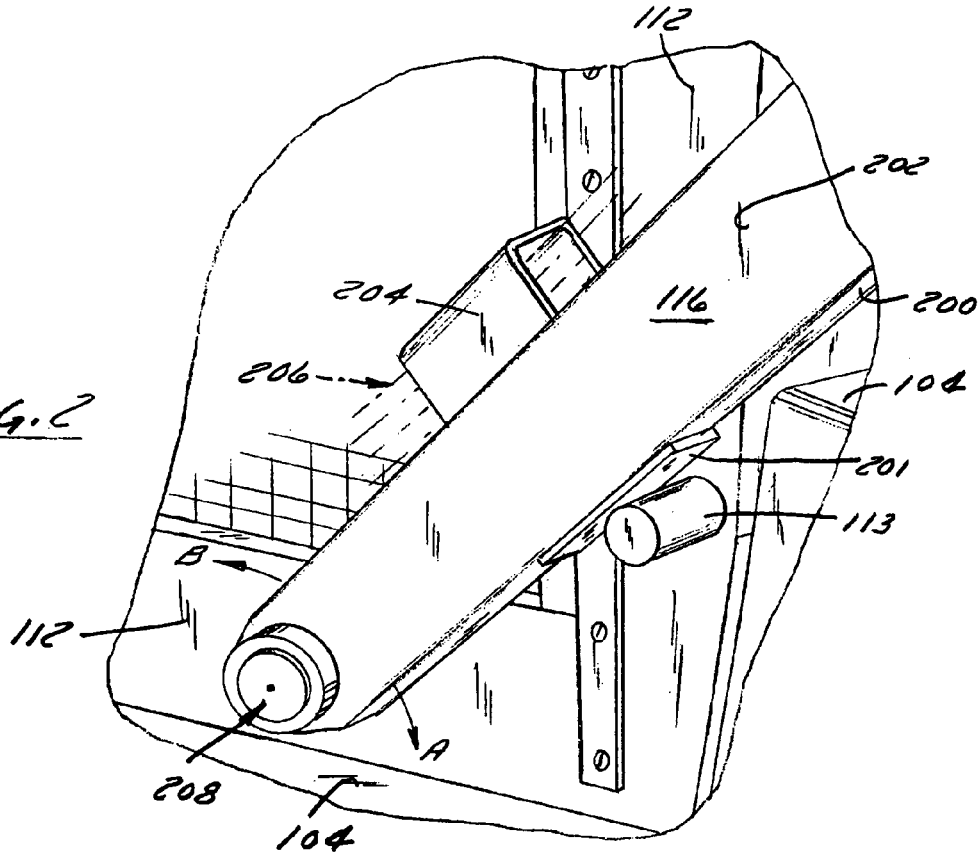
FIG. 2 is a partial perspective view of the skid steer loader from FIG. 1 showing a loader arm with locking pin extended and without the invention attached.
Figure 3:
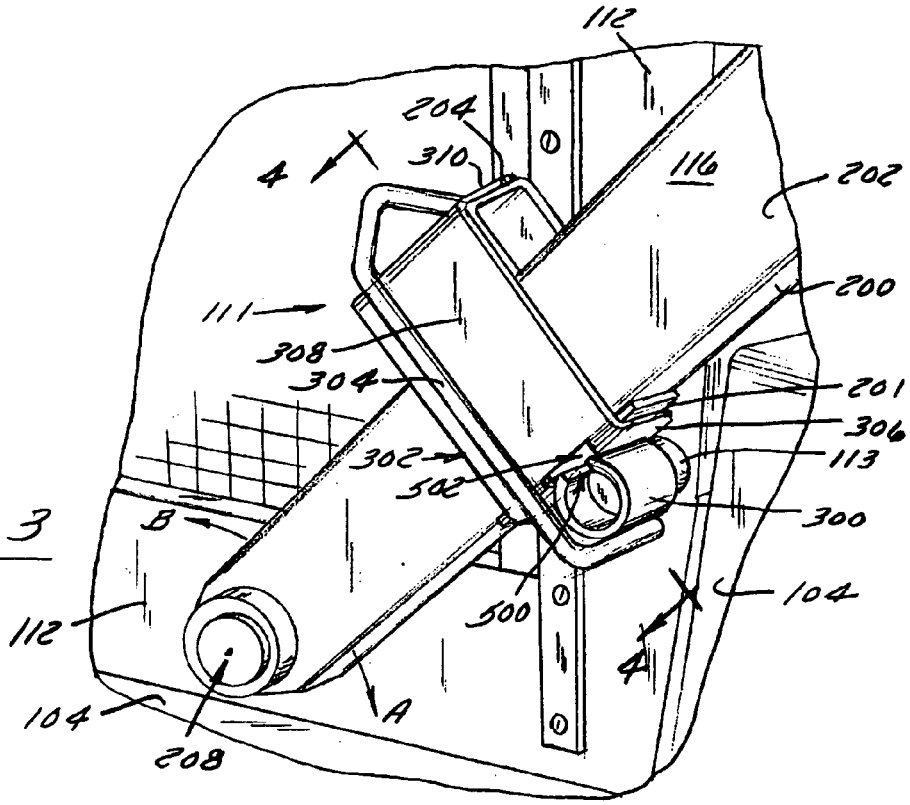
FIG. 3 is identical to FIG. 2 except the invention is attached.

FIGS. 2 & 3 show the left lower boom arm 116 in intermediate locked position and the locking pin 113 in its second interfering position. The FIGURES are identical except FIG. 3 shows the boom clamp 111 installed and does not show the hydraulic cables 206. The locking pin 113 extends outward through the sidewall 112 and beneath the lower boom arm 116. The lower boom arm includes a lower surface 200, a wear plate 201, an outer surface 202, an upper surface 400 (FIG. 4), an inner surface 402 (FIG. 4), a protective shroud 204 and hydraulic cables 206 (shown in phantom). The lower surface, inner surface, outer surface and upper surface are fixed to each other such that they form a beam of rectangular cross section. The wear plate 201 is parallel to and fixed to the bottom of the lower surface 200, and strengthens the area where the boom rests on the locking pin 113. The wear plate only extends 4–6", providing a stop for the locking pin to rest against. The shroud 204 is also generally rectangular in cross section, and is attached to the upper surface 400 of the lower boom arm 116. In the present embodiment, the shroud does not extend the entire length of the lower boom arm, but only extends 6–8", and is open at both ends. This is sufficient to restrain the hydraulic cables 206 inside the shroud. The cables run parallel to the lower boom arm 116, entering the shroud 204 at one open shroud end and leaving at the other open shroud end.

The lower boom arm 116 pivots about a point 208 where it is connected to the sidewall 112. The lower boom arm pivots in a first direction downward, shown by arrow A. The lower boom arm also pivots in a second direction upward, shown by arrow B. The locking pin 113 contacts the wear plate 201 of the lower boom arm 116, preventing the lower boom arm from pivoting in the first direction A beyond it's current intermediate locked position. In FIG. 2 there is nothing preventing the lower boom arm from pivoting in the second direction B.

FIG. 3 shows the lower boom arm 116 in its intermediate locked position, the locking pin 113 extended to its second interfering position, and the boom clamp 111 installed onto the lower boom arm 116 and locking pin 113. The lower boom arm is locked from pivoting upward or downward. The boom clamp comprises a pin sleeve 300, a boom restraint 302 and a handle 304. The pin sleeve 300 is configured to slide around the locking pin 113. The sleeve is cylindrical with an inside diameter slightly larger than the outside diameter of the locking pin. The restraint 302 is c-shaped and fixed to the sleeve, and is configured to slide around the lower boom arm 116. The handle 304 is a rod bent into a generally semicircular shape, fixed at one end to the restraint 302 and fixed at the other end to the sleeve 300. The restraint is further made up of a first plate 306, a second plate 308 and a third plate 310. The first plate 306 is fixed to the top of the sleeve 300 and is disposed generally parallel to the lower surface 200 of the lower boom arm 116. The second plate 308 is fixed to the first plate and is disposed generally vertically and parallel to the outside surface 202. The third plate 310 is fixed to the second plate and is disposed generally parallel to the upper surface 400. The second plate is long enough such that the first plate 306 and third plate 310 define an opening therebetween wide enough to surround the lower boom arm 116.

In FIG. 3 the lower boom arm is prevented from pivoting in the second direction B by the third plate 310 of the restraint 302. Thus the addition of the boom clamp locks the lower boom arm 116 (and thus the entire boom structure 110 via the four-bar linkage) in the intermediate position.

Figure 4:
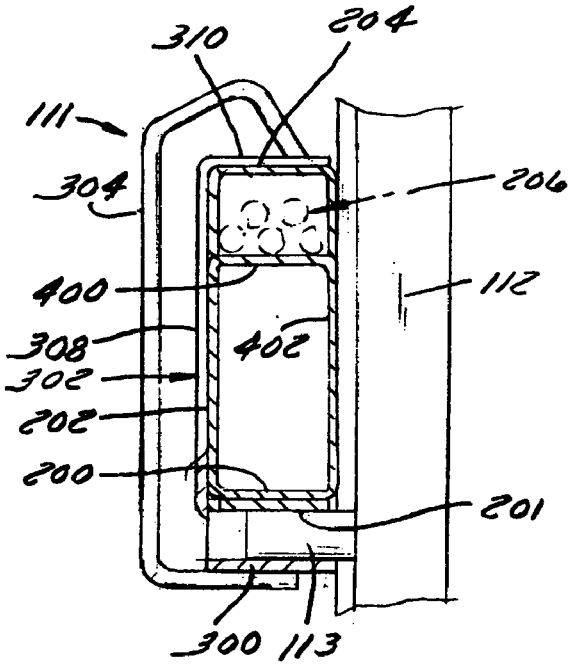
FIG. 4 is a cross section view of the skid steer loader taken at line 4—4 of FIG. 3 showing the cab wall, boom and extended locking pin, with the invention attached.

FIG. 4 shows a partial cross section of the lower boom arm and locking mechanism taken at line 4—4 of FIG. 3. The rectangular cross section of the lower boom arm 116 beam is clearly evident, as a box formed by surfaces 400, 402, 200 & 202. The protective shroud 204 is a similar cross section extending upward from the beam. The wear plate 201 is fixed to the bottom of the lower surface 200 of the lower boom arm 116 and touches the top of the locking pin 113. The handle 304 is fixed to the third plate 310 and the bottom of the sleeve 300. By grasping the handle and pulling, the boom clamp 111 may be quickly removed from the vehicle without the use of any tools.

Figure 5:
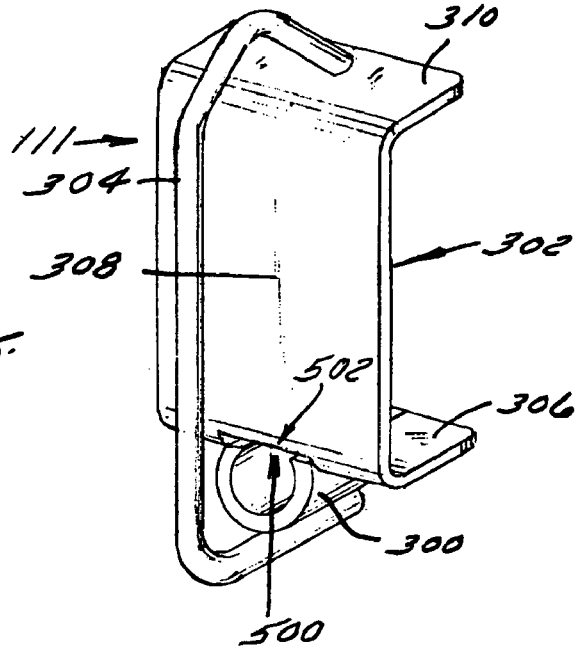
FIG. 5 is a perspective view of the invention from the handle (back) side.
Figure 6:
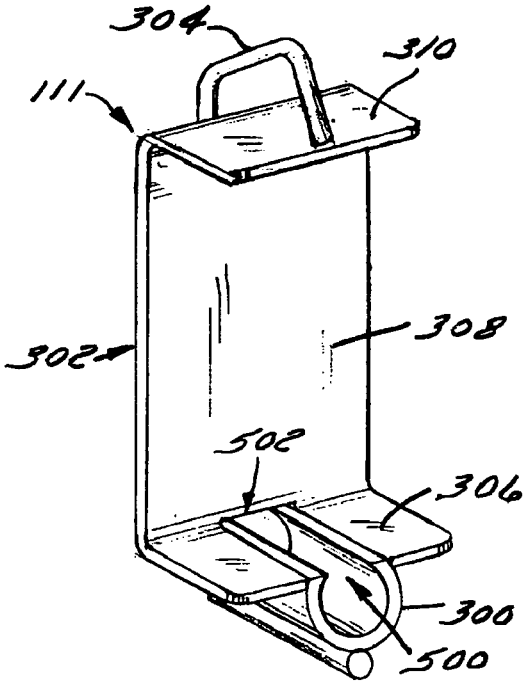
FIG. 6 is a perspective view of the invention from the front side.

FIGS. 5 and 6 show two perspective views of the boom clamp 111 removed from the vehicle. Typically, the boom clamp is installed after the lower boom arm 116 has been lowered all the way to the locking pin 113. This means that there is no space between the locking pin 113 and the wear plate 201 of the boom. Thus the sleeve 300 has a gap 500 in the outside of the cylinder along the top edge of the cylinder, and the first plate 306 has a corresponding gap 502 in the central section. The sleeve 300 and restraint 302 are joined by a weldment along each side of the gaps 500, 502. If a different intermediate position of the lower boom arms is desired, the boom clamp could be configured with a continuous cylinder sleeve 300 and a spacer between the sleeve and the restraint 302. This would lock the arms in a position higher than that of the locking pins alone, equal to the original height plus the width of the spacer. In this case, the locking pins would not directly contact the lower boom arm.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. For example, the boom clamp may be attached upside down, after the boom has been lowered below the locking pin, such that the pin prevents upward movement and the boom clamp prevents downward movement—allowing the pin/clamp combination to work with the boom at two different levels with only one pin predetermined height. There may be multiple locking pins at predetermined heights on each side of the skid steer loader, and the clamps may be attached at any pair of pins, thereby locking the arms at a plurality of predetermined heights. The coupling between the sleeve and the restraint need not be fixed, as in a weldment, but may be variable. The coupling may be fixed with a spacer such that there is a considerable separation between the locking pin and the boom. The locking pin may be a rectangular bar or other shape, and may project in a non-orthogonal manner across the plane of boom movement. The sleeve may be rectangular or some other shape, as long as it captures the locking pin. The restraint may be made of one continuous plate, and may be semicircular in shape. The protective shroud surrounding the cables may be inside the boom arm housing rather than outside. The handle may be a different shape, may be attached at only one end, and may be attached to either the restraint or the sleeve or both.

Accordingly, the following claims are intended to protect the invention broadly as well as in the specific form shown.

We claim:

1. A boom clamp for a work vehicle having a lock and a boom, said lock configured to prevent movement of the boom in a first direction, said clamp comprising:

a restraint configured to engage the boom; and a sleeve fixed to the restraint, the sleeve configured to engage the lock;

wherein the restraint prevents the boom from moving in a second direction.

2. The boom clamp of claim 1, wherein the second direction is opposite the first direction.

3. The boom clamp of claim 1, wherein the lock is movable between a first position and a second position, wherein the lock does not prevent the boom from moving in the first direction when the lock is in the first position, wherein the lock prevents the boom from moving in the first direction when the lock is in the second position, and further wherein the restraint prevents the boom from moving in the second direction when the lock is in the second position.

4. The boom clamp of claim 1, further comprising:

a handle configured to be grasped by an operator during installation and removal of the clamp.

5. The boom clamp of claim 1, wherein the sleeve is configured to surround the lock.

6. The boom clamp of claim 1, wherein the lock is a pin and the sleeve is a cylinder.

7. The boom clamp of claim 6, wherein the restraint comprises:

a first plate fixed to the sleeve and configured to face a lower surface of the boom;

a second plate fixed to the first plate and configured to extend parallel to the boom; and a third plate fixed to the second plate configured to face an upper surface of the boom.

8. The boom clamp of claim 1, wherein the boom further includes;

hydraulic lines; and a shroud surrounding the hydraulic lines;

wherein the restraint is configured to surround the shroud.

9. A boom lock for a skid steer loader, said skid steer loader having a chassis, an operator cab removably attached to the chassis, and a boom pivotally coupled to the operator cab, boom lock comprising:

first means for preventing the boom from pivoting in a first direction with respect to the cab, wherein the first means comprises a locking pin movably attachable to the cab; and second means for holding the first means and the boom together, wherein the second means comprises a boom restraint and a pin sleeve.

10. The boom lock of claim 9, wherein the second means is removably attached to the first means and the boom.

11. A method for locking a boom on a work vehicle, comprising the steps of:

extending a locking pin to prevent motion of the boom in a first direction; and coupling a clamp to the locking pin and boom after the step of extending, to prevent motion of the boom in a second direction;

wherein the step of coupling includes sliding the clamp over the locking pin after the step of extending.

12. A method for locking a boom on a work vehicle, comprising the steps of:

extending a locking pin to prevent motion of the boom in a first direction; and coupling a clamp to locking pin and boom after the step of extending, to prevent motion of the boom in a second direction;

wherein the clamp is c-shaped and the step of coupling includes sliding the clamp around the boom.

13. The method of claim 12, wherein the step of coupling includes sliding the clamp around a protective shroud.

* * * * *